United States Patent [19]

Millhimes et al.

[11] 4,386,818

[45] Jun. 7, 1983

[54] POLARITY INDICATING CONNECTOR FOR BATTERY JUMPER CABLES

[75] Inventors: Wayne L. Millhimes, Hershey; Daniel J. Murren, Dillsburg, both of Pa.

[73] Assignee: AMP Incorporated, Harrisburg, Pa.

[21] Appl. No.: 257,689

[22] Filed: Apr. 27, 1981

[51] Int. Cl.[3] ..... H01R 3/00; H01R 25/02

[52] U.S. Cl. ..... 339/113 L; 339/29 B; 339/49 R

[58] Field of Search ..... 339/113 L, 29 B, 49 R; 362/800

[56] References Cited

U.S. PATENT DOCUMENTS

| | | | |
|---|---|---|---|
| 3,794,957 | 2/1974 | Winkler | 339/49 R |
| 3,795,830 | 3/1974 | Richardson | 362/800 X |
| 4,206,493 | 6/1980 | Towne et al. | 362/800 X |
| 4,238,722 | 12/1980 | Ford | 339/29 B X |
| 4,272,142 | 6/1981 | Zapf | 339/29 B |

*Primary Examiner*—Eugene F. Desmond

*Attorney, Agent, or Firm*—Allan B. Osborne

[57] ABSTRACT

A two-piece connector for battery jumper cables wherein the connector portions each indicate the positive and negative battery terminals to which the cables from the connector are to be connected. The connector further includes a two state LED device which provides a green light when the cables are connected to a battery with polarity in the manner stated on the connector and a red light when the polarity is reversed. The circuitry, therefore, is contained directly in each connector half. The connector halves are hermaphroditic so that they can not be connected in reverse polarity condition.

1 Claim, 3 Drawing Figures

POLARITY INDICATING CONNECTOR FOR BATTERY JUMPER CABLES

BACKGROUND OF THE INVENTION

1. The Field of the Invention

This invention relates to a connector for battery jumper cables and, more specifically to a connector for battery jumper cables which indicates on each connector half the polarity on each jumper cable prior to making connection.

2. The Prior Art

Battery jumper cables are well known in the prior art. Such cables normally comprise a pair of cables having a clamp at each end of each cable, the cables being colored differently in order to be able to determine and locate the ends of each individual cable for proper connection to a battery. Cables of this type often do not properly indicate to the user the proper connection to the battery such as in the case of darkness where cable color is not discernible. In addition, the batteries themselves often do not adequately define the polarity of the lugs thereon. It is therefore difficult, if not often impossible to determine the polarity of the various battery cables. This presents a great problem since it is well known that connection of two batteries with reversed polarity can cause explosion of one of the batteries with attendant personal injury or major car damage or, as is more often the case, damage to the charged one of the two batteries being utilized. It is therefore desirable to provide a mechanism to overcome this problem and permit the user of the battery cable to ensure that the batteries will be connected together properly before the connection is in fact made.

SUMMARY OF THE INVENTION

This problem is overcome in accordance with the present invention wherein a set of battery jumper cables is provided with an intermediate hermaphroditic connector, the connector having two portions, each portion being marked to indicate, for each terminal, the polarity thereof, with a further LED device capable of providing two different colors, one when the cable clamps are connected to the proper poles of the battery associated therewith, a different color when the polarities are reversed. This procedure is followed for both connector halves. When both connector halves indicate proper battery connection, since the connector halves are hermaphroditic or polarized, the connector cables are then connected together to provide a proper and properly polarized connection. This eliminates the problem inherent in the prior art battery jumper cables as stated hereinabove.

DESCRIPTION OF THE PREFERRED EMBODIMENT

Figure 1:
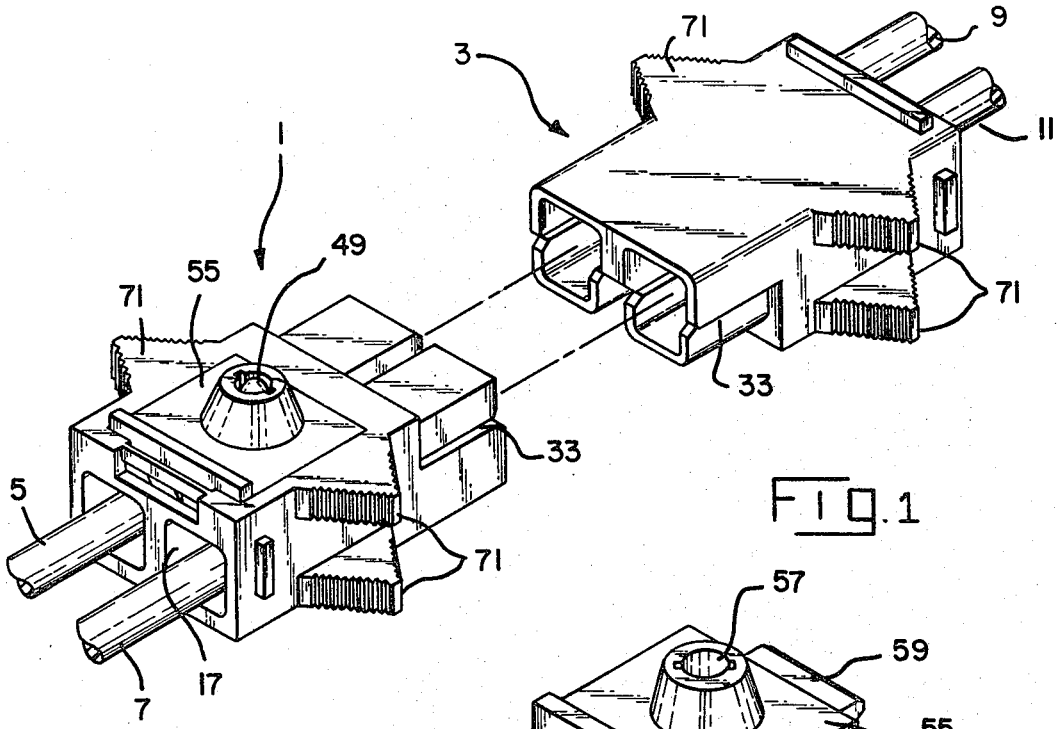
FIG. 1 is a three dimensional view of a pair of battery jumper cable connectors with the jumper cables connected therein in accordance with the present invention.

Referring first to FIG. 1 there is shown a set of jumper cables 5, 7, 9 and 11 for connecting together a pair of batteries (not shown) with an intermediate connector composed of connector halves 1 and 3. The cables from each battery to the associated connector half are shown as 5 and 7 connected in connector half 1 and 9 and 11 connected in connector 3.

Figure 2:
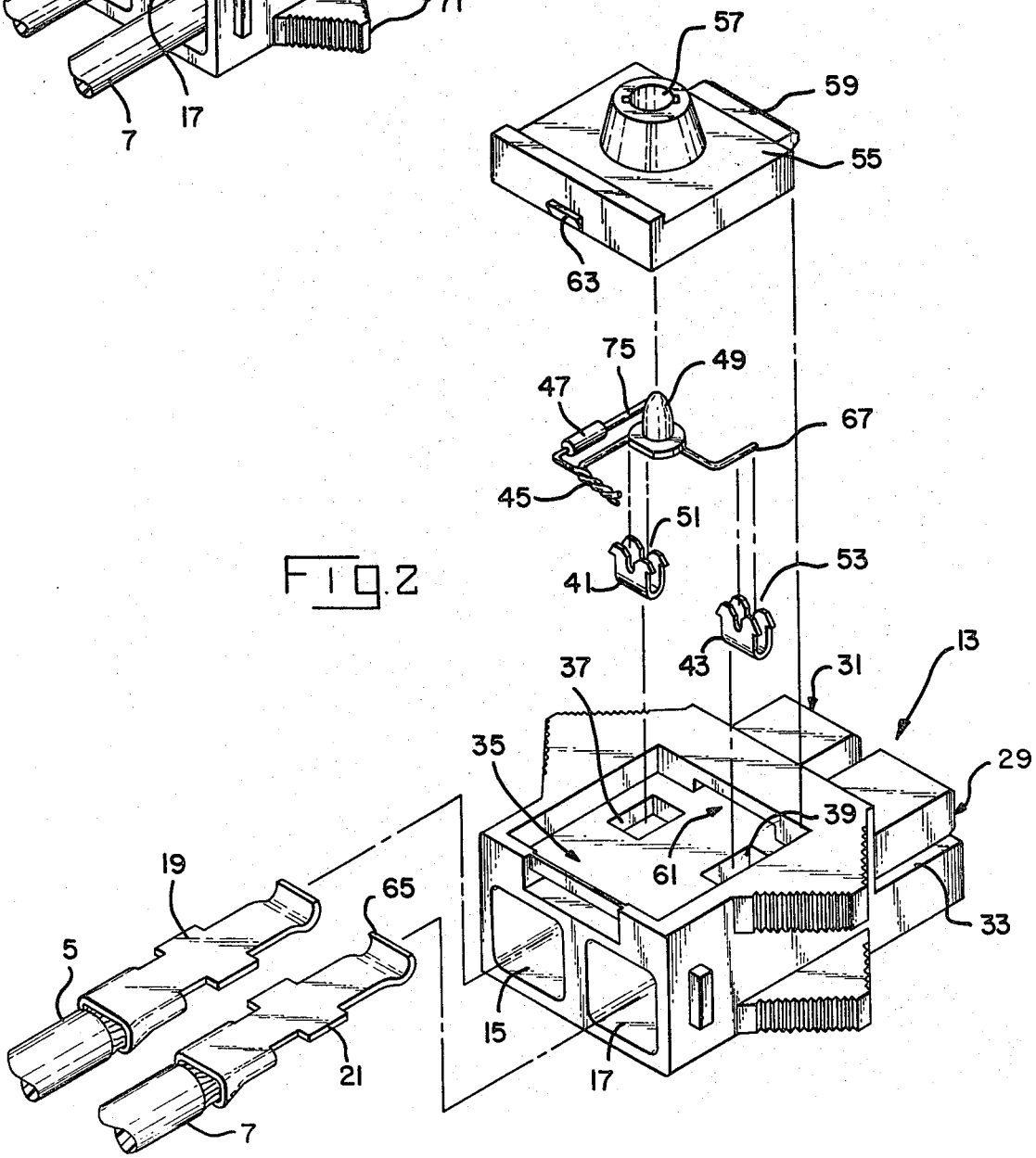
FIG. 2 is an exploded view of one of the battery jumper cable connector halves of FIG. 1.
Figure 3:
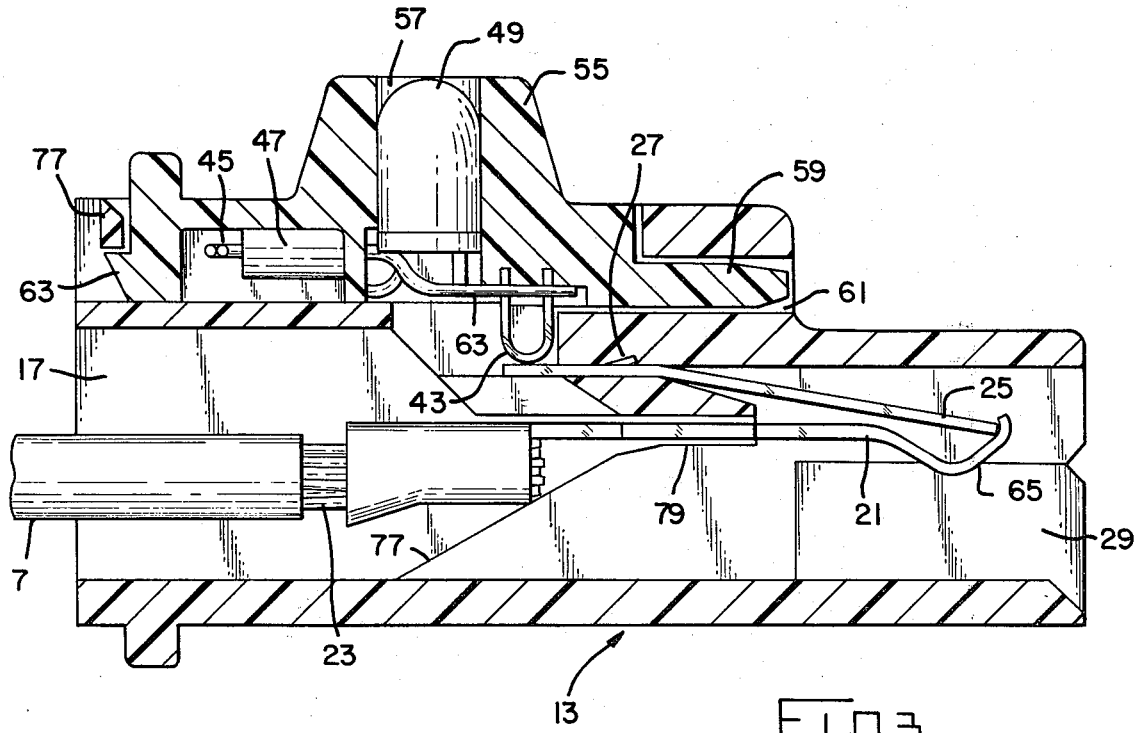
FIG. 3 is a cross-sectional view of a battery jumper cable connector half in accordance with the present invention.

Referring now to FIGS. 2 and 3, there is provided a detailed showing of one of the connector halves 1 or 3, the description being provided with respect to connector half 1, it being understood that connector half 3 is identical. It is also noted that the connector halves 1 and 3 are hermaphroditic so that they can be connected together in only one orientation.

The connector half 1 includes an electrically insulating housing 13 which includes a pair of apertures 15 and 17 for receiving contacts 19 and 21 attached to cable 5 and 7. The cables 5 and 7 are crimped in the contacts 19 and 21 as better shown in FIG. 3 after the cables 7 and 5 have been partially stripped to provide bare wire 23 at the ends thereof. The housing 13 has a hollow interior. A spring member 25 which extends into the hollow region has an upwardly extending line 27 which locks the spring into the housing. The housing also includes a step portion 33 at its mating end to provide the hermaphroditic feature mentioned hereinabove so that the connector halves 1 and 3 can be connected in only one alignment. This prevents and avoids the possibility of an erroneous connection with improperly placed terminals being connected together. The housing 1 further includes an indented upper section 35 having a pair of apertures 37 and 39 therein which extend into the hollow interior region 17. A pair of displacement contacts 41 and 43 are positioned in the apertures 37 and 39 respectively. The twisted and soldered wires 45 from a resistor 47 and a LED 49 connect these elements in series and lead 75 from resistor 47 is positioned in the groove 51 of the contact 41. The other anode terminal of the LED 49 is positioned in the groove 53 of the contact 43. The cover 55 has an opening 57 through which the LED 49 is visible, the cover also including a finger 59 which extends into a groove 61 in the housing 1. The cover 55 also includes a lip 63 which is lockable under a ledge 77 in the housing (FIG. 3) to secure the components within the connector half 1 in the manner shown in FIG. 3. The cover 55 is removable by forcing ledge 77 and lip 63 apart.

When the components are connected as shown in FIG. 3, it can be seen that the contact 21 has entered the aperture 17 and rides along a ramp 77 unitl it is locked by the spring 25 which moves into the cup-shaped end 65 of the contact 21 to lock the contact within the connector half. The contact 43 is in electrical contact with the spring 25, the latter being electrically conductive and in contact with contact 21 as shown in FIG. 3. The other contact 19, shown in FIG. 2, will be in electrical contact with the contact 41.

In operation, a pair of battery jumper cables 5 and 7 is connected to the connector half 1 and a second pair of battery jumper cables 9 and 11 is connected to a second connector half 3 as shown in FIG. 1. Each of the connector halves will be marked to indicate the polarity intended at each side of the connector half and the resistor 47 and LED 49 will be connected to reflect the polarity sensed and provide an indication thereof. The connector half will then indicate at the LED device whether the cables 5 and 7 are connected to battery terminals in the manner intended or with reversed polarity by the colors of the LED. If the indication is that the polarity is reversed, the cables can then be reversed on the battery lugs initially. This is also done for the connector half 3 with the cables 9 and 11 which are connected to the other battery involved. When both connector halves indicate that the polarity of the cables attached thereto are correct or as intended, the connector halves are then connected together by pushing together the connector halves by means of the ears 71 whereby contacts 19 and 21 will mate with similar contacts in the other connector half.

It can be seen that there is provided a simple and inexpensive connector whereby the polarity on battery cables can be determined prior to making connections.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

What is claimed is:

1. Polarity indicating connector for battery jumper cables, comprising a. a pair of mateable housings with each housing including a pair of contacts positioned in separate passages extending therethrough, said contact having cable attaching means at one end and contact blades at another end with the free end of the blades being curved back to provide a cup-shaped end, and a pair of electrically conductive spring members with one end staked in the housings and with the other end received in the cup-shaped end on the contacts;

b. polarity indicating means including an indentation in one housing with a pair of apertures extending from the indentation through the housing to the spring members, a pair of U-shaped displacement contacts having wire-receiving slots at the free ends thereof, said contacts being positioned in the apertures with the bights engaging the spring members to effect electrical contact with the contacts through said spring members, and with the free ends extending into the indentation, and an LED electrically connected to the free ends of the contacts by wires being received in said slots; and c. a cover having an opening therethrough, said cover covering the indentation with the opening exposing the LED.

* * * * *